US007963219B2

(12) United States Patent
Robinson

(10) Patent No.: US 7,963,219 B2
(45) Date of Patent: Jun. 21, 2011

(54) PRESS FORCE SENSING AND DISPLAY

(75) Inventor: Benjamin B. Robinson, Smithfield, PA (US)

(73) Assignee: Stahls' Inc., St. Clair Shores, MI (US)

( * ) Notice: Subject to any disclaimer, the term of this patent is extended or adjusted under 35 U.S.C. 154(b) by 0 days.

(21) Appl. No.: 11/741,461

(22) Filed: Apr. 27, 2007

(65) Prior Publication Data

US 2008/0216676 A1 Sep. 11, 2008

Related U.S. Application Data

(60) Provisional application No. 60/893,791, filed on Mar. 8, 2007.

(51) Int. Cl.
*B30B 15/34* (2006.01)
*B30B 15/14* (2006.01)

(52) U.S. Cl. ..... 100/326; 100/50; 100/99; 100/233; 156/583.1

(58) Field of Classification Search ..... 100/50, 100/51, 52, 99, 233, 293, 326; 156/359, 156/579, 580, 583.1; 38/16, 17, 23
See application file for complete search history.

(56) References Cited

U.S. PATENT DOCUMENTS

| | | | | |
|---|---|---|---|---|
| 5,252,171 | A * | 10/1993 | Anderson et al. | 156/358 |
| 5,379,689 | A * | 1/1995 | Timmons et al. | 100/43 |
| 5,412,340 | A * | 5/1995 | Tanikoshi | 330/68 |
| 5,551,218 | A * | 9/1996 | Henderson et al. | 53/504 |
| 5,631,622 | A * | 5/1997 | Hauber et al. | 338/2 |
| 5,746,122 | A * | 5/1998 | Gietz et al. | 100/43 |
| 7,225,530 | B2 * | 6/2007 | Ravert et al. | 29/739 |
| 2007/0116880 | A1 * | 5/2007 | Anderson et al. | 427/372.2 |

FOREIGN PATENT DOCUMENTS

| | | |
|---|---|---|
| DE | 20105506 | 7/2001 |
| EP | 0569603 | 11/1993 |
| EP | 1074380 | 2/2001 |
| EP | 1321285 | 6/2003 |
| EP | 1679182 | 7/2006 |
| WO | WO-9820317 | 5/1998 |

OTHER PUBLICATIONS

International Search Report—PCT/IB2007/051604 filed Apr. 30, 2007.

* cited by examiner

*Primary Examiner* — Jimmy T Nguyen
(74) *Attorney, Agent, or Firm* — Rader, Fishman & Grauer PLLC

(57) ABSTRACT

A press is described having an upper platen and a lower platen. A support is adapted to close the upper platen with the lower platen by applying a force therebetween. A sensor is adapted to detect the force and a display is in communication with the sensor.

9 Claims, 4 Drawing Sheets

700

| Pos | Ref load | Test load |
|---|---|---|
| 1 | 51 | 0.089 |
| 2 | 118 | 0.131 |
| 3 | 219 | 0.184 |
| 4 | 282 | 0.249 |
| 5 | 356 | 0.303 |
| 6 | 440 | 0.358 |
| 7 | 555 | 0.432 |
| 8 | 660 | 0.502 |
| 9 | 760 | 0.58 |
| 8 | 650 | 0.502 |
| 7 | 565 | 0.439 |
| 6 | 465 | 0.367 |
| 5 | 366 | 0.307 |
| 4 | 269 | 0.248 |
| 3 | 221 | 0.188 |
| 2 | 122 | 0.13 |
| 1 | 53 | 0.085 |

PRESS FORCE SENSING AND DISPLAY

CROSS REFERENCE TO RELATED APPLICATIONS

This application claims priority to U.S. Provisional Application Ser. No. 60/893,791, entitled "PRESS FORCE SENSING AND DISPLAY", filed Mar. 8, 2007, the entire contents of which are incorporated by reference herein.

TECHNICAL FIELD

The embodiments described herein are generally directed to presses, and more particularly to a heat transfer press that include platens.

BACKGROUND

Heat applied transfers include a variety of indicia with inks, material layers, and adhesives that become bonded to material layers, for example, apparel such as shirts, jackets, or the like, upon pressurized contact and heating of the transfers and apparel between press platens. However, presses are typically manually operated and rely on a user (e.g., an operator) to control the force applied through the platens.

In the case of lettering as a graphic image, the lettering may be accurately and quickly transferred to the apparel without bleeding or partial interruptions in the bonding of the transfer, as long as the presses can be operated at a predetermined temperature for a predetermined time and at a predetermined pressure. Nevertheless, heat applied transfer presses must be simple, manually operated devices in order to satisfy the user's need to economically but quickly apply various lettering, symbols and numbering indicia selected by a customer and which must be applied to a selected piece of apparel. Such an apparatus must accommodate many variations in the arrangement of transfers and apparel, as well as the types of transfers and apparel materials available.

The accuracy and precision of the temperature, the pressure and the time duration for which these parameters are applied to the transfers are particularly important to complete an efficient bonding of the transfers to materials. In particular, depending upon materials and the structure of the indicia to be applied to the apparel, indicia may be subject to inconsistent application conditions throughout the surface of apparel to which the transfer is applied. For example, excessive temperature may cause the ink or adhesive to bleed into the apparel material so that the indicia becomes discolored or a blend of different colors thus changing the original appearance of the indicia intended to be applied. Likewise, the application of excessive pressure may cause bleeding of the colors while insufficient pressure between the platen pressing surfaces may result in blotched or unattached areas where the indicia failed to adhere completely to the garment.

Although some means are known to provide improved image results on various substrates, they tend to be difficult to use, time consuming and labor intensive. As in most businesses, since the applying, forming, fixing, etc. of images on substrates is becoming more competitive, it is becoming increasingly more important to be able to form high quality images on various substrates using different processes in a more efficient, inexpensive, and less-time consuming manner.

The thermal or heat transfer presses are used to apply graphic images on textiles or other similar substrates, or to press foil onto a substrate. The presses are general purpose machines capable of being used to apply any number of graphic images on any number of substrates with minimal setup. However, the optimal pressure for applying graphics and/or foil is not known to a press operator. Many press operators go by their "feel", given their experience, to apply an appropriate amount of pressure. Thus, the graphic image may not be fully bonded to the textile or substrate given the imprecision of a press operator's "feel." Additionally, a press operator may apply too much pressure and damage the graphic image, foil, or the textile or substrate itself. In many cases, the appropriate amount of pressure applied is a function of the temperature of the platens, the textile or substrate material, the textile or substrate thickness, the compressive nature of the graphic image, foil, textile and/or substrate, as well as the size of the graphic image or foil.

Moreover, there is a lack of consistency with the same press operator, as well as comparing different presses and press operators. Therefore, there exists a need in the art to provide an improved press for applying a consistent and repeatable force to apply graphic images or foils to textiles or substrates. For example, a device is needed that allows a press operator to consistently apply a known force to a platen. Moreover, the device allows a press operator to consistently apply the same force during multiple uses to provide the appropriate bonding of a graphic image or foil to a textile or substrate over a single use or multiple uses.

SUMMARY

A press is described having an upper platen and a lower platen. A support is adapted to close the upper platen with the lower platen by applying a force therebetween. A sensor is adapted to detect the force and a display is in communication with the sensor.

In another example, a press includes a frame and a lower platen in communication with the frame. An upper platen is also included. An arm connects the frame with the upper platen. The arm is adapted close the upper platen with the lower platen by applying a force to the upper platen. A sensor is located near the frame and is adapted to detect the force.

Also disclosed is a method that includes the steps of measuring a force applied to a transfer press and displaying the force.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 2:
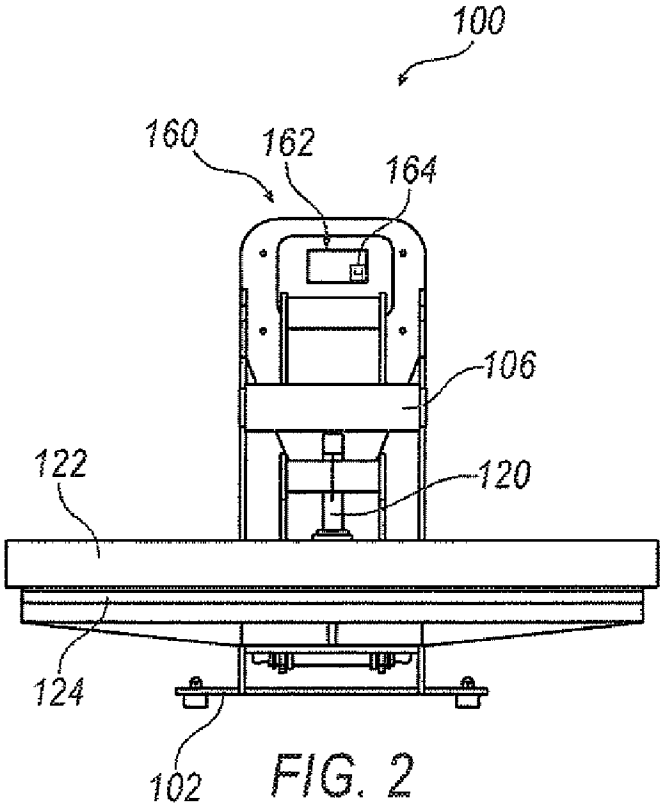
FIG. 2 is a front elevational view of the transfer press in FIG. 1.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

The term "platen" as used throughout the specification is defined hereinafter to include, but is not limited to, a work structure of a machine tool and a generally flat plate of a press that presses a material. However, the platen may also be shaped or adapted to operate with a worked component. The term "pivot" or any variation thereof such as "pivotally" as used throughout the specification is defined hereinafter to include, but is not limited to, a rod or shaft on which a related part that rotates or swings; the act of turning on or as if on a pivot, to cause to rotate, revolve, or turn; and to mount on, attach by, or provide with a pivot or pivots. The term "heating element" as used throughout the specification is defined hereinafter to include, but is not limited to, a component that transforms fuel or electricity into heat. The term "sensor" as used throughout the specification is defined hereinafter to include, but is not limited to, a component that senses stress, pressure, and/or force.

Figure 1:
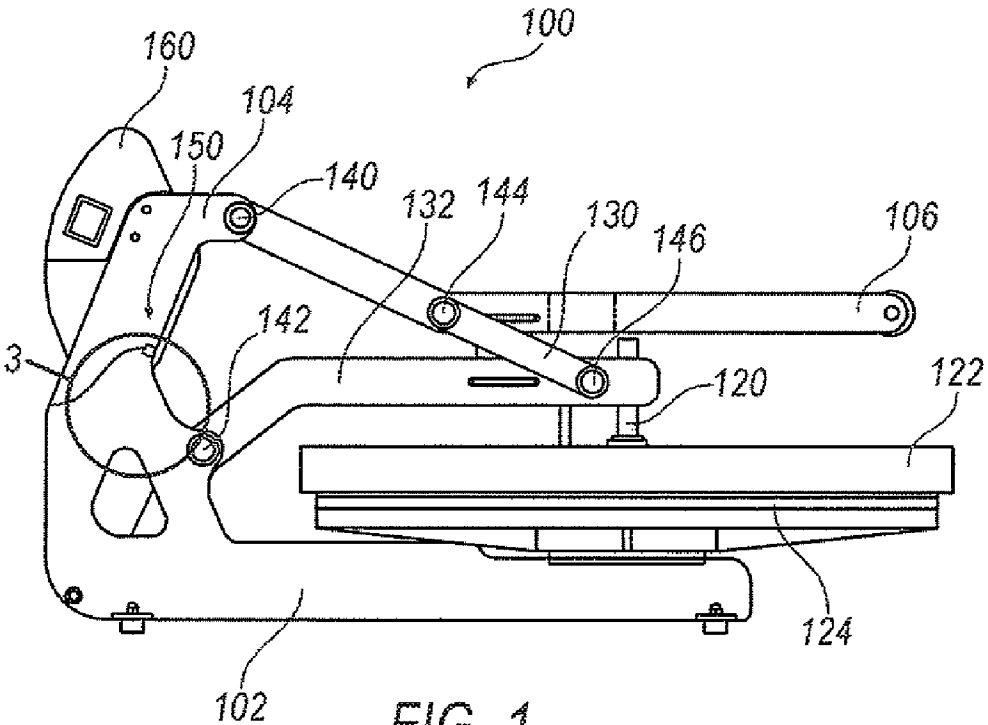
FIG. 1 is a side elevational view of an embodiment of a transfer press in a closed position.

Referring first to FIG. 1, a side elevational view of an embodiment of a heat applied transfer press 100 in a closed position is shown. The heat applied transfer press 100 includes a lower platen 124 mounted on a base frame 102. A support aim 132 is pivotally secured to base frame 102 at a pivot mechanism to support an upper platen 122. Force is applied to upper platen 122 through a spindle 120. The mechanism for displacing upper platen 122 includes an operating arm 106 accessible to a press worker for manually displacing upper platen 122 by the pivot mechanism between an open and the closed position with respect to lower platen 124. When a closing force is applied by operating arm 106, upper platen 122 is generally aligned with lower platen 124 as upper platen 122 approaches the closed position by a pivotal connection, such that upper platen 122 is substantially parallel with lower platen 124 in a closed position. Transfer press 100 further includes pivot points 140, 142, 144, 146, allowing platens 122, 124 to be pressed together with a mechanical advantage through downward pressure applied to operating arm 106 and a linkage 130.

As also shown in FIG. 2, at least one platen and upper platen 122 preferably includes a heating element such as conventional resistive heating elements and the like, which may be formed as serpentine or otherwise wound throughout the surface area of upper platen 122. The heating element is coupled to a typical power supply through a switch and may be configured for adjusting the temperature of the heating element. Further, the temperature of the heating element may be adjusted at a visual display 162. In addition, upper platen 122 carries a thermocouple sensor which is wired in a conventional manner to generate temperature information at visual display 162. Visual display 162 is mounted for exposure to the area occupied by the press operator positioned for manipulating and controlling operating arm 106. The electrical circuit for the heating element includes a temperature control such as a thermostat. In addition, a timer control provides a perceptible indication to the worker manipulating operating arm 106. Although a simple mechanical spring type timer may be used, an automatic timing system utilizing an automatic proximity sensor and digital display counter in visual display 162 as described in greater detail below may be used.

A control unit 160 includes computational and control elements (e.g., a microprocessor or a microcontroller). Control unit 160 generally provides time monitoring as well as temperature monitoring and control. Visual display 162 further includes a force readout 164 that indicates the amount of force applied between upper platen 122 and lower platen 124, Force readout 164 is used by the operator to adjust the amount of force applied to operating arm 106 to achieve a desired force between platens 122, 124 as is explained below in detail.

Support arm 132 includes an opening for receiving a pair of gas springs that also engage base frame 102. The gas springs are under constant compression providing a generally constant push biasing upper platen 122 into the open position. The gas springs provide a predetermined biasing force that requires the press operator to push operating arm 106 in a downward direction to move upper platen 122 into the closed position. By way of example, in one embodiment, approximately seven pounds of force in a downward direction on operating arm 106 places transfer press 100 in the closed position.

A connector positions upper platen 122 in a substantially parallel alignment with a lower platen 124 as it approaches a closed position. Moreover, the closed position can be varied by an adjuster that raises the level of upper platen 122 with respect to lower platen 124. As a result, regardless of the thickness of the material, the transfers to be applied, or the thickness of the support pads to be used between platens 122, 124, the alignment of platens 122, 124 avoids uneven pinching of the material and the transfers positioned between upper and lower platens 122, 124. Moreover, pads assist the pressure distribution regardless of irregularities in the thicknesses of the heat applied transfers and the apparel to which it is applied. Furthermore, the extended length of operating arm 106 provides substantial leverage for ease in manually operating transfer press 100 to displace platens 122, 124 between the upper and lower positions, even during application and releasing of high pressure engagement between platens 122, 124.

Figure 3:
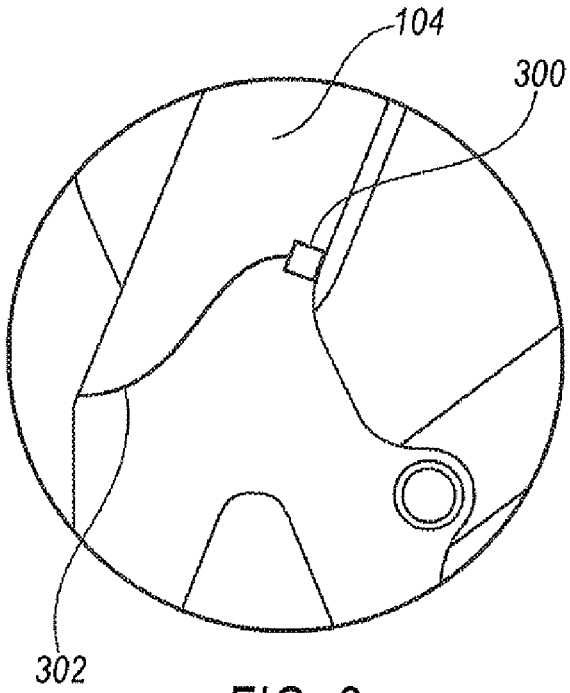
FIG. 3 is a partial side elevational view of an embodiment of a force sensor for use with the transfer press of FIG. 1.

Referring to FIG. 3, a partial side elevational view of an embodiment of a force sensor for use with transfer press 100 of FIG. 1 is shown near a flexure region 150. A sensor 300 is directly attached to an upright 104 to sense the amount of strain in upright 104 when platens 122, 124 are forced together through application of force to operating arm 106, A wire bundle 302 connects sensor 300 to control unit 160. Depending upon the embodiment of sensor 300, wire bundle 302 includes a number of wires to transmit electrical signals of sensor 300 that represent the amount of strain on upright 104. Moreover, wire bundle 302 may be shielded to reduce electrical interference upon the signal from sensor 300 to control unit 160. Such shielding, while unnecessary in some applications, may be used in noisy production environments or may be used where the heating element of transfer press 100 is controlled, for example, through pulse width modulation of large currents. For the purposes of clarity, sensor 300 is shown on the outer side of upright 104. However, in a production environment, sensor 300 may be mounted to the inside of upright 104 such that sensor 300 is protected against incidental contact that may damage sensor 300 or wire bundle 302.

Sensor 300 in an embodiment is a strain gauge that is directly affixed to upright 104 in a position where maximum deflection of upright 104 occurs at flexure region 150 (shown in FIG. 1). Because upper and lower platens 122, 124 may be changed out with different dimensions, sensor 300 primarily measures the force applied at spindle 120. In producing transfer press 100, a powder coat is typically applied to the components including upright 104. However, where sensor 300 is to be mounted, the powder coat is masked such that sensor 300 can be applied directly to upright 104. The application may be, for example, by placing sensor 300 directly against upright 104. Alternatively, the powder coating may be ground off to expose the underlying metal of upright 104 for the direct mounting of sensor 300. In other embodiments, sensor 300 may be a load cell placed between spindle 120 and upper platen 122. In another embodiment sensor 300 may be selected as a piezo-type resistive sensor. Sensor 300 may also include a smart sensor wherein a measurement of stress is transmitted via wire bundle 302 in a digital format or encoded format. Alternatively, sensor 300 may be placed at alternate locations on transfer press 100 to sense forces applied between upper platen 122 and lower platen 124.

When sensor 300 is selected to be a strain gauge type for measurement, the strain gauge typically includes a thin insulating material that carries a thin metal pattern (e.g., a foil) that is sensitive to strain in bending, stretching, or compressing. When force is applied to operating arm 106 platens 122, 124 are pressed together and a stress is imparted to transfer press 100. The stress is also present on upright 104 that is the mechanical linkage between upper and lower platens 122, 124. The stress is measured by sensor 300, which is typically placed at a high-flexure region of upright 104, and the signal is sent via wire bundle 302 to control unit 160. A high-flexure region is a location on upright 104 that bends or strains more significantly than, for example, base frame 102. Selection of a location, including a high-flexure region, for the placement of sensor 300 includes matching the flex or strain of upright 104 to the specifications of the sensor. That is to say, the sensor should be determined and matched to a region of upright 104 that will provide enough flex or strain detectable by sensor 300 when normal operating pressures and loads are used with transfer press 100.

Control unit 160 includes measurement electronics to detect and manipulate the signal provided from sensor 300. When sensor 300 is a strain gauge, control unit 160 may include a Wheatstone bridge arrangement to detect the low level signals provided by sensor 300. Control unit 160 further includes scaling and/or processing elements to convert the signal provided by sensor 300 into a display value suitable for use by an operator as shown in force readout 164. Control unit 160 may also provide numerical references for stored force values. Alternatively, control unit 160 may scale the sensor output to a real-world numerical reference (e.g., SI units), including units of force or pressure.

Figure 4:
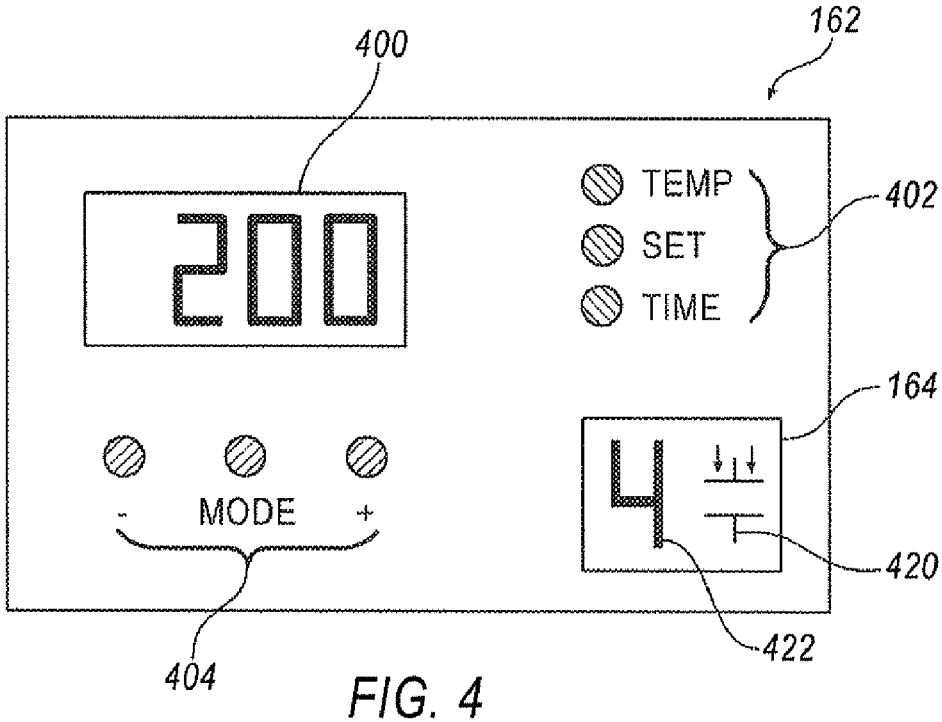
FIG. 4 is a front elevational view of a digital display for use with the force sensor of FIG. 3 and the transfer press in FIG. 1.

Referring to FIG. 4, a front elevational view of visual display 162 for use with force sensor 300 of FIG. 3 and transfer press 100 of FIG. 1 is shown. Visual display 162 includes a multipurpose display 400, function indicators 402, and function switches 404. Additionally, visual display 162 includes force readout 142 that further includes a digital force indication 422 and an icon 420.

Digital force indication 422 is a display visible to an operator that provides a consistent indication of force applied to spindle 120. When platen 122 is in the open position, force indication 422 reads zero (0). When an operator presses down on operating arm 106 and force is applied to spindle 120, force indication 422 increases proportionally to the force at spindle 120. In an example, as a light force is applied to spindle 120, a one (1) is displayed. When a heavy force is applied to spindle 120, a nine (9) is displayed. The calibration of sensor 300 to a particular transfer press 100 may be accomplished through calibration stored in a non-volatile memory (e.g., an EEPROM) contained within control unit 160. Icon 420 is a graphical representation of upper and lower platens 122, 124 as well as arrows indicating force applied therebetween. By providing icon 420 in proximity to force indication 422, an operator understands the meaning of force indication 422. In an embodiment, the number displayed by force indication 422 is correlated with real world units. For example, when a one (1) is displayed, this represents one (1) pound at spindle 120 and when a seven (7) is displayed then seven (7) pounds is applied to spindle 120.

Control unit 160 further includes mechanisms for controlling the heat and duration of transfer press 100. Control unit 160 includes an on/off switch for selectively coupling a power source and operating a temperature circuit selectively controlled with the aid of he visual display 162. Visual display 162 shows the power light operating and heater indication light, on/off switches, and temperature. The switch is coupled by conductors to the terminal strip, which is conveniently located, for example, on the back of frame member or stanchion upper platen 122 to couple the power source to a heating circuit through a control mechanism embedded in control unit 160. The control mechanism includes the thermostat visual display 162, and an audible alarm with a digital, microprocessor based control with an automatically resettable timer and a digital LED display in a manner which eases a worker's interface with the controls.

One embodiment of transfer press 100 includes a feature that when the power switch has been plugged in, control unit 160 initiates transfer press 100 in a standard operating mode. The standard operating mode includes having the temperature automatically set to a desired predetermined temperature and the closure duration is predetermined before an indicator, for example, an audible buzzer is sounded. An electro-magnet enables the predetermined parameters of time and temperature to be executed and permits a workers selective return to a modified transfer operation. In particular, initial depression of operating arm 106 enables the electro-magnet to hold upper platen 122 depressed against lower platen 124 for a predetermined time. In one embodiment, the user is provided with a visual indication of the temperature set mode by an illuminated set mode light, for example a yellow light, simultaneously with illumination of temperature light, for example, a red light. Visual display 162 may also provide signaling that at least one of a predetermined temperature, a predetermined time, and a predetermined pressure has been achieved. Further, an audible indicator may also provide signaling that at least one of a predetermined temperature, a predetermined time, and a predetermined pressure has been achieved. In this mode of operation, control unit 160 enables the user to decrease the platen temperature by setting a decrease control, for example, depressing the decrease button; or an increase control, for example, depressing the increase button.

Figure 5:
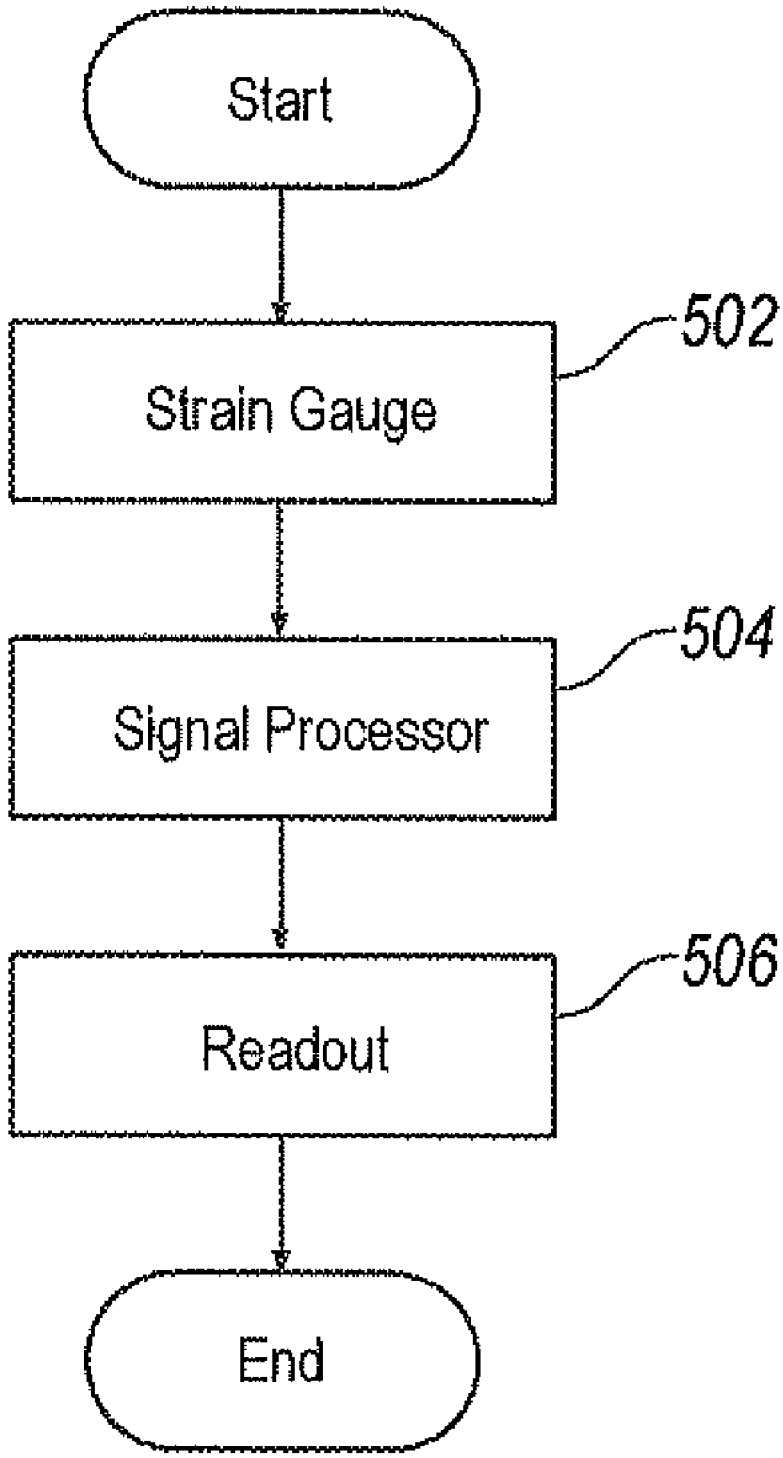
FIG. 5 is a process flow of press force sensing and display for use with the sensor of FIG. 3 and the transfer press of FIG. 1.

FIG. 5 is a process flow of transfer press 100 force sensing and display for use with sensor 300 of FIG. 3 and transfer press 100 of FIG. 1. At step 502, when a force is applied to transfer press 100 via operating arm 106, sensor 300 (e.g., a strain gauge) is perturbed such that a signal is generated. The signal may be a discrete voltage or when a strain gauge is used a resistive measurement may be provided to control unit 160. In an embodiment, the signal is proportional to the force applied to spindle 120.

At step 504, control unit 160 reads and measures the signal provided by sensor 300. A signal processing function then takes place in control unit 160 to convert the signal of sensor 300 into a usable value. For example, a characteristic curve may be applied where the signal of sensor 300 is an input and a force unit is an output. The characteristic curve may be a linear function, or alternatively a non-linear function to compensate for the placement of sensor 300, any non-linearity of the signal, or other factors.

At step 506, a readout is provided to an operator of transfer press 100 in the form of a digital numerical output at force readout 164, and in force indication 422. In this way, an operator of transfer press 100 may look and see precisely the force applied through the downward pressure applied to operating arm 106. When an operator knows the type of graphic image or foil that is to be applied, as well as the thickness or compressible nature of the textiles or other similar substrates, an optimal pressure is applied thereto by adjusting the downward force applied to operating arm 106. If too much pressure is applied, the operator may decrease the force applied to operating arm 106 until force readout 164 shows the optimal value. Similarly, if too little force is applied to operating arm 106, the operator may increase the force applied thereto until force readout 164 shows the optimal value. Thus, by using the press force sensing and display described herein, an operator need not rely on "feel" or other non-quantified methods of applying pressure through platens 122, 124 to bond a graphic image or foil to a textile or substrate. Moreover, an operator may use different presses, or different operators may use the same transfer press 100 while providing consistent bonding results.

In general, the signal from sensor 300 is correlated by control unit 160 into a repeatable digital reference number associated with inter-platen pressure. In this way, the complete set of desired combination of time, temperature and pressure at which heat applied transfer is properly accomplished given the thickness of material, the type or composition of the adhesive or inks to be applied, and the style and composition of the lettering material or the apparel. For each combination of factors (e.g., the textile or substrate, the type or composition of the adhesive or inks to be applied, and the style and composition of the lettering material or the apparel) an optimal force number is determined and communicated to the operator of transfer press 100 such that the optimal force is used in bonding the graphic, lettering, or foil to the textile or substrate.

Figures 6, 7:
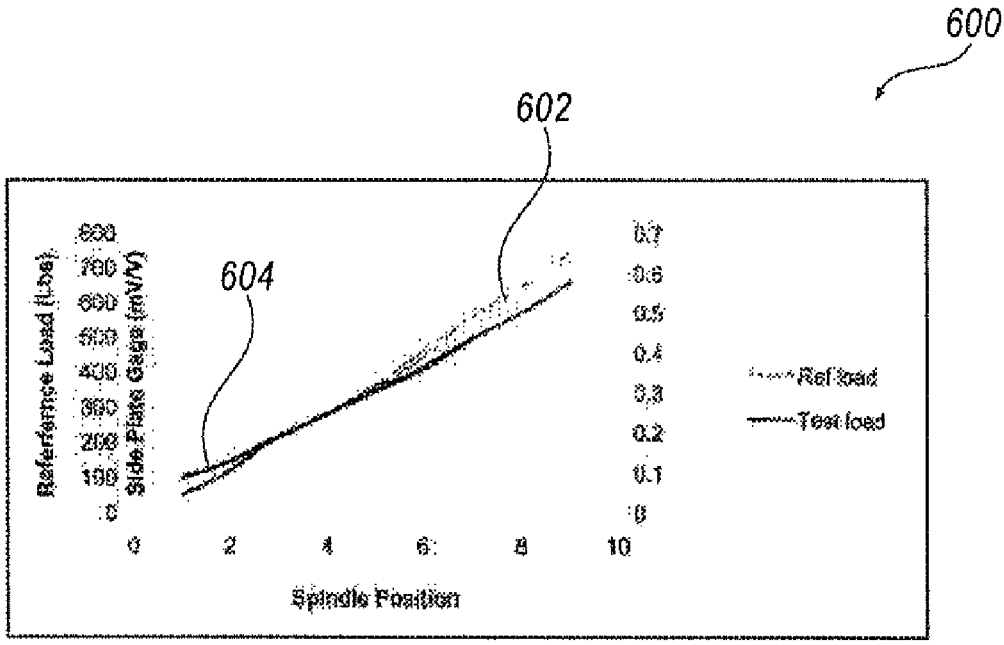
FIG. 6 is a graph of the spindle position and a signal provided by the sensor of FIG. 3.
FIG. 7 is a table for producing the graph of FIG. 6.

FIG. 6 is a graph 600 of spindle position and the signal provided by sensor 300. As shown, the actual performance indicated by a test load curve 604 closely tracks a reference load 602. As discussed above, calibrations may be added by a signal processor that is connected (directly or indirectly) to sensor 300 and visual display 162. By calibrating sensor 300, a user then receives a highly accurate indication of the load present between upper platen 122 and lower platen 124. Such calibration allows for the removal of features (e.g., an offset, a non-linearity, etc.) that that may reduce accuracy. FIG. 7 is a table 700 of spindle position, a reference load, and a test load for use in calibrating sensor 300, control unit 160, and force readout 164 as shown graphically in FIG. 6.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A heat transfer press comprising:

an upper platen;

a lower platen, one of the upper and lower platens including a heating element configured to apply heat to an article clamped between the upper and lower platens;

a support adapted close said upper platen with said lower platen by applying a force therebetween;

a sensor adapted to detect said force; and a display in communication with said sensor, said display configured to display a numerical reference of said force and a force icon simultaneously to a user, said force icon including a representation of at least one of said upper and lower platens, said display configured to display said force icon simultaneously with and in proximity to said numerical reference, said force icon thereby indicating a meaning of said numerical reference.

2. The press of claim 1, wherein said sensor comprises a strain gauge.

3. The press of claim 1, wherein said sensor comprises a foil-type strain gauge.

4. The press of claim 1, wherein said support includes a coating material, and said sensor directly connected to said support at an exposed portion of said support, said exposed portion of said support being free of said coating material.

5. The press of claim 1, wherein said sensor converts strain into an electrical signal for communication to said display.

6. The press of claim 5, further comprising a signal processor in communication with said sensor to convert said signal into said numerical reference for use by said display.

7. The press of claim 6, wherein said signal processor converts said signal into a unit of force.

8. The press of claim 6, wherein said signal processor applies a calibration with said signal to generate a calibrated unit of force.

9. The press of claim 1, wherein said display comprises a digital display.

* * * * *